US007198682B2

(12) United States Patent
Cicale' et al.

(10) Patent No.: US 7,198,682 B2
(45) Date of Patent: Apr. 3, 2007

(54) PROCESS FOR THE PRODUCTION OF GRAIN ORIENTED ELECTRICAL STEEL

(75) Inventors: Stefano Cicale', Rome (IT); Stefano Fortunati, Rome (IT); Giuseppe Abbruzzese, Rome (IT)

(73) Assignee: Thyssenkrupp Acciai Speciali Terni S.p.A., Terni (IT)

( * ) Notice: Subject to any disclaimer, the term of this patent is extended or adjusted under 35 U.S.C. 154(b) by 333 days.

(21) Appl. No.: 10/450,977

(22) PCT Filed: Dec. 17, 2001

(86) PCT No.: PCT/EP01/14880

§ 371 (c)(1),
(2), (4) Date: Nov. 13, 2003

(87) PCT Pub. No.: WO02/50318

PCT Pub. Date: Jun. 27, 2002

(65) Prior Publication Data

US 2004/0099342 A1 May 27, 2004

(30) Foreign Application Priority Data

Dec. 18, 2000 (IT) ..... RM00A0676

(51) Int. Cl.
*H01F 1/147* (2006.01)

(52) U.S. Cl. ..... 148/111; 148/113

(58) Field of Classification Search ..... None
See application file for complete search history.

(56) References Cited

U.S. PATENT DOCUMENTS 5,039,359 A * 8/1991 Yoshitomi et al. ..... 148/111
5,066,343 A * 11/1991 Nakashima et al. ..... 148/111
6,159,309 A * 12/2000 Kurosaki et al. ..... 148/308
6,488,784 B1 * 12/2002 Fortunati et al. ..... 148/308
6,739,384 B2 * 5/2004 Schoen et al. ..... 164/480
6,893,510 B2 * 5/2005 Fortunati et al. ..... 148/111
2001/0030001 A1 * 10/2001 Hayakawa et al. ..... 148/111

FOREIGN PATENT DOCUMENTS

| | | |
|---|---|---|
| EP | 0390160 | 10/1990 |
| EP | 0398114 A2 | 11/1990 |
| EP | 0398114 A3 | 11/1990 |
| EP | 0540405 | 5/1993 |
| EP | 0997540 | 5/2000 |
| WO | WO 98/28451 | 7/1998 |
| WO | WO 98/46802 | 10/1998 |

* cited by examiner

*Primary Examiner*—John Sheehan
(74) *Attorney, Agent, or Firm*—McCormick, Paulding & Huber LLP

(57) ABSTRACT

A process for the production of electrical steel strips, in which a strip is directly cast from molten steel and contains alloy elements apt to generate a precipitation of sulphides and/or nitrides apt to inhibit the grain growth. The strip is hot rolled in-line with the casting operation at a temperature between 1250 and 1000° C., and in which the strip is coiled after hot rolling at a temperature of less than 780° C. if sulphides are utilized, or at a temperature of less than 600° C. if nitrides, or nitrides plus sulphides, are utilized.

15 Claims, No Drawings

PROCESS FOR THE PRODUCTION OF GRAIN ORIENTED ELECTRICAL STEEL

CROSS-REFERENCE TO RELATED APPLICATIONS

This application is entitled to the benefit of and incorporates by reference in their entireties essential subject matter disclosed in International Application No. PCT/EP01/14880 filed on Dec. 17, 2001 and Italian Patent Application No. RM2000A000676 filed on Dec. 17,2000.

FIELD OF THE INVENTION

The present invention refers to a process for the production of oriented grain electrical steel and, more precisely, to a process in which a strip directly continuously cast from a molten steel of the type Fe-3% Si is hot rolled.

BACKGROUND OF THE INVENTION

The production of grain oriented electrical steel is based on the metallurgical phenomenon called secondary recrystallisation, in which a primary recrystallised strip undergoes after cold deformation an annealing in which, by means of a slow heating, it is brought up to about 1200° C. During this heating, at a temperature comprised between 900 and 1100° C. the grains having an orientation close to {110} <001> (Goss grains), which in the primary recrystallised strip are a minority, abnormally grow at the expenses of the other crystals, to become the only grains present in the microstructure, with macroscopic dimensions (5–20 mm).

The mechanism on which the secondary recrystallisation is based is rather complex. The experts agree that secondary recrystallisation is the result of a delicate equilibrium among three factors: the mean diameter of the primary grain (governing the attitude of the crystals to grow), the texture of the strip, in a decarburised state (which can constitute a small advantage in the growth of the Goss crystals) and the presence of evenly distributed fine second phases (which, slowing down the tendency to grow of all the crystals, lets the Goss grains, present as a minority in the primary recrystallised strip, to acquire a dimensional advantage. Thus, at the higher temperatures of 900–1100° C. at which second phases are dissolved into the matrix thus permitting the grains to freely grow, the Goss grains, slightly larger than the other, can rapidly grow at the expenses of the latter.

In the traditional technologies for the production of grain oriented Fe-3% Si (Takahashi, Harase: Mat. Sci. Forum Voll. 204–206 (1996) pp 143–154; Fortunati, Cicalé, Abbruzzese: Proc. 3rd Int. Conf. On Grain Growth, TMS Publ. 1998, p. 409), necessary microstructure and texture of the product are obtained by means of a process requiring the following sequence of steps: slab casting, hot rolling, cold rolling, recrystallisation annealing. The desired distribution of second phases is obtained by heating the stab at high temperature (>1350° C.) to dissolve them, and re-precipitating the same in fine form during the hot rolling step and during the subsequent annealing of the hot rolled strip.

The second phases usually utilised as grain growth inhibitors are substantially of two kinds: (i) sulphides and/or selenides of manganese, copper or mixtures thereof, and (ii) aluminium nitrides, alone or in combination with the above sulphides and/or selenides.

In the state of the art for the production of grain oriented electrical steel, some patents (EP 0 540 405, EP 0 390 160) describe production processes in which the grain oriented electrical steel is produced, by means of secondary recrystallisation, starting from a directly cast strip (Strip Casting) and not from a hot rolled band. This kind of technology obviously leads to important economies in the production costs, in view of the production cycle simplification. However, due to the complexity of the secondary recrystallisation mechanism, to obtain a product of good magnetic characteristics a very strict control is necessary of the process parameters starting from the steel casting to the final annealing.

EP 0 540–405 discloses that to have a good quality of the product after the secondary recrystallisation it is necessary to produce in the solidified skin of the strip grains having the {110} <001> orientation, which is obtained by means of a quick cooling of the solidified skin in contact with the casting rolls, at a temperature of under 400° C.

EP 0 390 160 discloses that to have a good quality of the product, after secondary recrystallisation, it is necessary to control the strip cooling, in a first stage with a cooling rate of less than 10° C./s down to 1300° C., and then with a cooling speed of more than 10° C./s between 1300 and 900° C. By slow cooling down to 1300° C. a random texture of the cast strip is favoured, thus enhancing the formation of the desired {110} <001> grains, while the fast cooling between 1300 and 900° C. promotes the formation of fine second phases, able to act as inhibitors during the secondary recrystallisation.

Present inventors extensively studied the production of electrical steel by strip casting and found an alternative to the above patents, for the production of very high quality grain oriented Fe—Si. This new process, matter of present invention, is easy to control at an industrial scale and is able to give a product of good constant quality.

SUMMARY OF THE INVENTION

The present inventors reduced to perfection a process, which is the subject-matter of present invention, in which a strip, directly cast from liquid steel comprising the alloy elements apt to produce sulphides and/or nitrides precipitates useful as grain growth inhibitors, is continuously hot rolled, as it cools down after casting, at a temperature comprised between 1250 and 1000° C. and in which said hot rolled band is coiled at a temperature lesser than 780° C., if sulphides are utilised as grain growth inhibitors, lesser than 600° C. if nitrides are utilised and lesser than 600° C. if sulphides and nitrides are jointly utilised; this allows the production of a finished product having excellent and constant magnetic characteristics, after a combination of subsequent thermo-mechanical treatments described in more detail in the following description, but in any case similar to the ones utilised in the traditional processes.

Further objects of present invention will be easily derivable from the following description.

DETAILED DESCRIPTION OF THE INVENTION

The present inventors found that an in-line hot rolling, just after casting and during the cooling of the cast strip, at a temperature comprised between 1250 and 1000° C. is essential to obtain a product having a stable good quality.

The reason of this good result is believed to be twofold. Starting the hot rolling at a temperature at which precipitation of second phases did not start yet, thus increasing the dislocation density in the strip, greatly rises the number of nucleation sites for the second phases precipitation, thus encouraging a finer precipitation. Hot rolling, in addition, induces along with a thickness reduction of about 25% a greater percent of the Goss grains, which favours a well oriented secondary recrystallisation, as experts know very well.

Moreover, it was verified that also the presence in the steel of oxides influences the magnetic quality of the end product, in that they can act as precipitation nuclei.

More specifically, it was found that an oxygen content, as oxides, in the steel higher than 30 ppm impairs the quality of the end product, in that it causes precipitation of all the second phases before the hot rolling stag; without a high density of dislocations the second phases will precipitate in coarse form, thus resulting not useful as grain growth inhibitors.

Other experimental evidences, seem to show that the strip coiling temperature, after in-line hot rolling, can have a fundamental role in obtaining good magnetic properties of the end product; in particular, according to the utilised inhibitors, there is a maximum coiling temperature over which it not possible to obtain a product of acceptable characteristics. This result could be explained in that the coiled strip cannot dissipate heat efficiently and remains for a long time at a temperature close to the coiling one. This, in turn, helps a coarsening of the precipitates (the so called Oswald Ripening) which depresses the capability of the second phases to act as inhibitors.

A detailed study on the effect of the different families of inhibitors lead to the following conclusions: if sulphides/selenides are utilised as inhibitors, said maximum coiling temperature is 780° C., while if nitrides are utilised, said maximum coiling temperature is 600° C.

In case both nitrides and sulphides/selenides are utilised at the same time, very good magnetic characteristics are obtained at a coiling temperature not higher than 600° C.

It was also verified that if, using nitrides as inhibitors, a coiling temperature higher than 600° C. is utilised, good results can be obtained by nitriding the strip before the secondary recrystallisation.

The studies of present inventors did show that obtaining a good electrical steel starting from a continuously cast strip requires a careful and dedicate choice of operating conditions, which moreover have to be defined also taking into account the micro-alloying elements present in the steel composition.

The process according to present invention is, therefore, a process for the production of grain oriented electrical steel by means of direct continuous casting of a steel strip 1.5 to 5 mm thick, comprising from 2.5 to 3.5 wt % Si up to 1000 ppm C and elements apt to generate precipitates of sulphides/selenides, or nitrides, or both sulphides/selenides and nitrides. In the case of sulphides/selenides, the steel must comprise at least an element chosen between Mn and Cu as well as at least an element chosen between S and Se. In the case of nitrides, the steel must comprise Al and N, and optionally at least an element chosen between Nb, V, Ti, Cr, Zr, Ce. In case nitrides and sulphides/selenides are chosen together, elements of both above groups must be present.

The remaining will be iron and elements which will not modify the final characteristics of the product. Said steel will be cast as a strip, for instance by means of a twin of parallel, cooled and counter-rotating rolls, so that the total oxygen content measured on the as-cast strip, after removal of the surface oxide, is lesser than 30 ppm.

The strip is in-line hot rolled after casting, within a temperature interval at the beginning of rolling comprised between 1100 and 1250° C., a reduction ratio comprised between 15 and 50%, and coiled at a maximum temperature (T max) depending on the kind of inhibitors utilised. If sulphides/selenides are utilised, said T max is 780° C., if nitrides are utilised said T max is 600° C., and if both classes of inhibitors are utilised said T max is 600° C. In the last two cases, T max could be comprised between 600 and 780° C., provided a nitriding step is applied to the strip by means of an addition of ammonia in the furnace atmosphere in the last part of the decarburisation annealing, before starting the secondary recrystallisation.

Said strip undergoes, then, a number of thermo-mechanical treatments, usual in the production of grain oriented electrical steels and well known to the experts, such as: annealing, cold rolling in one or more steps, decarburisation annealing, secondary recrystallisation annealing, and so on. However, the specific sequence, annealing temperatures, reduction ratios, as later specified, act in co-operation with the above process parts.

For instance, the hot rolled strip can be annealed, cold rolled, also in the stages with a reduction ration in the second stage comprised between 50 and 93%, decarburised, coated with an MgO-based annealing separator and annealed to obtain said secondary recrystallisation. The secondary recrystallised strip can be coated with an insulating coating which can be also tensioning.

Preferably, according to a first aspect of present invention, the elements utilised for the precipitation of second phases are chosen between:

S+(16/39)Se: 50–300 ppm
Mn: 400–2000 ppm
Cu: <3000 ppm.

The strip, after in-line hot rolling, is coiled at a temperature lesser than 780° C.; it is then possibly annealed and quenched, then pickled and cold rolled to a thickness of between 0.15 and 0.5 mm.

Preferably, according to another aspect of present invention, the elements utilised for the precipitation of second phases are chosen between:

N: 60–100 ppm
Al: 200–400 ppm.

More preferably, the elements utilised for the precipitation of second phases are chosen between.

S+(16/39) Se: 50–250 ppm
Mn: 400–2000 ppm
Cu<3000 ppm
N: 60–100 ppm
Al: 200–400 ppm.

To said elements, at least an element chosen in the group consisting of Nb, V, Ti, Cr, Zr, Ce can be advantageously added.

The strip, after hot rolling, is coiled at a temperature of less than 600° C., annealed at a temperature comprised between 800 and 1150° C. and quenched. The strip is then cold rolled to a thickness of between 0.15 and 0.5 mm, possibly in double stage with intermediate annealing, with a reduction ratio in the last stage of between 60 and 90%.

If a strip, which should have been coiled at a temperature of less than 600° C., is in fact coiled at a temperature of between 600 and 780° C., it must be treated according to the following procedure: the strip, possibly annealed at a temperature of between 800 and 1150° C., is cold rolled to a thickness comprised between 0.15 and 0.5 mm with a reduction ratio of between 60 and 90%, possibly in double stage with intermediate annealing.

The strip is then decarburised and during the final part of this treatment it is nitrided by adding ammonia to the furnace atmosphere.

The main advantage of the process according to present invention is its peculiar stability and controllability on the industrial point of view, permitting to consistently produce a grain oriented silicon steel strip of very high quality.

The following examples are given only for illustrative purposes, not limiting the scope of present invention.

EXAMPLE 1

A steel having the composition of Table 1 was continuously cast in a strip-casting machine with twin counter-rotating rolls.

TABLE 1

| C [ppm] | Si [%] | Als [ppm] | N [ppm] | Mn [ppm] | S [ppm] | Cu [ppm] |
|---|---|---|---|---|---|---|
| 480 | 3.15 | 190 | 80 | 800 | 250 | 1400 |

The oxygen content of the strip, after removal of the surface scale, was 20 ppm. During the casting procedure, the strip thickness was modified as follows: 2.0 mm, 2.3 mm, 2.8 mm, 3.2 mm, 3.6 mm, 4.0 mm.

Strip lengths over 2.0 mm thick were on-line hot rolled at 1190° C. to a thickness of 2.0 mm. In any case, the strip was coiled at 550° C.

The strip was then divided into fractions, each with a single reduction ratio.

Said strips were then annealed in an annealing plus pickling line with a cycle comprising a first stop at 1130° C. for 5 s, and a second stop at 900° C. for 40 s, quenched starting from 750° C. and pickled.

The strips are then cold rolled in single stage to a thickness of 0.30 mm, decarburised at 850° C. in wet hydrogen+nitrogen atmosphere, coated with a MgO based annealing separator and box-annealed by heating at a rate of 15° C./h in a 25% $N_2$+75% $H_2$ atmosphere up to 1200° C., a stop at this temperature in pure hydrogen for 20 h. The magnetic characteristics of the strips are given in Table 2.

TABLE 2

| Tickness of cast strip | % hot rolling reduction | B800 (mT) |
|---|---|---|
| 2 | 0 | 1600 |
| 2.3 | 13 | 1750 |
| 2.8 | 29 | 1930 |
| 3.2 | 38 | 1950 |
| 3.6 | 44 | 1945 |
| 4 | 50 | 1950 |

EXAMPLE 2

A number of steels, whose composition is given in Table 3, were cast in a twin counter-rotating rolls strip casting machine at a thickness of 4.0 mm. During its cooling, the strip was on-line hot rolled at a temperature of 1200° C. to a thickness of 2.0 mm and coiled at 770° C.

TABLE 3

| n° | C [ppm] | Si [%] | Al [ppm] | Nb [ppm] | V [ppm] | N [ppm] | Mn [ppm] | S [ppm] | Cu [ppm] | O [ppm](*) |
|---|---|---|---|---|---|---|---|---|---|---|
| A | 300 | 3.15 | 250 | 50 | 20 | 90 | 740 | 235 | 1400 | 10 |
| B | 350 | 3.15 | 180 | 10 | 300 | 70 | 700 | 245 | 1800 | 12 |
| C | 500 | 3.15 | 120 | 800 | 20 | 85 | 750 | 235 | 2300 | 15 |
| D | 450 | 3.15 | 10 | 25 | 20 | 80 | 760 | 240 | 1800 | 10 |
| E | 480 | 3.15 | 12 | 21 | 10 | 80 | 780 | 230 | 1800 | 20 |
| F | 500 | 3.16 | 220 | 70 | 10 | 15 | 50 | 50 | 85 | 15 |

(*)Oxygen measured on the strip

After half the steel was cast, the coiling temperature was reduced to 550° C. Th strips obtained at both coiling temperatures were then treated as per Example 1. The magnetic quality obtained is shown in Table 4.

TABLE 4

| Steel type | Coiling T [° C.] | B800 [mT] |
|---|---|---|
| A | 770 | 1830 |
| B | 770 | 1825 |
| C | 770 | 1830 |
| D | 770 | 1835 |
| E | 770 | 1835 |
| F | 770 | 1550 |
| A | 550 | 1930 |
| B | 550 | 1950 |
| C | 550 | 1955 |
| D | 550 | 1870 |
| E | 550 | 1850 |
| F | 550 | 1850 |

EXAMPLE 3

The strips coiled at higher temperature of Example 2 were nitrided by adding ammonia in the atmosphere of the last part of the decarburisation furnace, up to obtain into the strip a total nitrogen content of about 200 ppm.

The magnetic quality obtained is shown in Table 5.

TABLE 5

| Steel type | Rolling T [° C.] | B800 [mT] |
|---|---|---|
| A | 770 | 1952 |
| B | 770 | 1948 |
| C | 770 | 1955 |
| D | 770 | 1835 |
| E | 770 | 1835 |
| F | 770 | 1865 |

EXAMPLE 4

A steel having the composition of Table 6 was cast.

TABLE 6

| C [ppm] | Si [%] | Als [ppm] | Nb [ppm] | Va [ppm] | N [ppm] | Mn [ppm] | S [ppm] | Cu [ppm] |
|---|---|---|---|---|---|---|---|---|
| 300 | 3.15 | 250 | 50 | 20 | 90 | 740 | 235 | 1400 |

During the casting operation, the oxygen content of the strip was raised from 15 ppm to 40 ppm at the end of casting. The obtained strip was then in-line hot rolled at 1180° C. from the initial 3.0 mm to a final 2.0 mm thickness.

The strip was then processed to final product as per Example 1. Table 7 shows the magnetic characteristics measured on the product, in function of the oxygen content.

TABLE 7

| O [ppm] | B800 [mT] |
|---|---|
| 10 | 1950 |
| 15 | 1930 |
| 25 | 1935 |
| 30 | 1850 |
| 40 | 1650 |

EXAMPLE 5

A number of steels, whose composition is shown in Table 8, was continuously cast in a twin, counter-rotating rolls strip casting machine at a thickness of 3.1 mm. The strips were then in-line hot rolled starting from a temperature of 1200° C., to a thickness of 2.0 mm and then coiled at 590° C.

TABLE 8

| n° | C [ppm] | Si [%] | Als [ppm] | Nb [ppm] | Va [ppm] | N [ppm] | Mn [ppm] | S [ppm] | Cu [ppm] |
|---|---|---|---|---|---|---|---|---|---|
| A | 300 | 3.15 | 280 | 10 | 20 | 90 | 740 | 230 | 1000 |
| B | 350 | 3.15 | 260 | 10 | 15 | 80 | 700 | 240 | 2100 |
| C | 500 | 3.15 | 120 | 1100 | 20 | 85 | 750 | 235 | 2200 |
| D | 450 | 3.15 | 110 | 20 | 600 | 80 | 760 | 240 | 1800 |
| E | 480 | 3.15 | 30 | 25 | 15 | 20 | 780 | 230 | 1800 |

When about half of the steel was cast, the operation was stopped and then resumed with a strip thickness of 2.0 mm, and coiled without rolling. The oxygen content of the cast strip was, after removal of the surface scale, of 20 ppm.

The strips were then annealed in an annealing plus pickling line, with a cycle comprising a first stop at 1130° C. for 5 s, and a second stop at 900° C. for 40 s, quenched starting from 750° C. and pickled.

The strips were then single-stage cold rolled to a thickness of 0.30 mm, decarburised at 850° C. in a wet hydrogen+nitrogen atmosphere, coated with an MgO based annealing separator and box annealed by heating at a rate of 15° C./h in a 25% $N_2$+75% $H_2$ atmosphere up to 1200° C., a stop at this temperature in pure hydrogen for 20 h.

After this treatment, the strip was thermal flattened and coated with an insulating coating. The obtained magnetic characteristics are shown in Table 9.

TABLE 9

| Steel Type | In-line hot Rolling | B800 [mT] |
|---|---|---|
| A | Yes | 1930 |
| B | Yes | 1930 |
| C | Yes | 1950 |
| D | Yes | 1955 |
| E | Yes | 1840 |
| A | No | 1730 |
| B | No | 1650 |
| C | No | 1640 |
| D | No | 1730 |
| E | No | 1720 |

EXAMPLE 6

Two steels, having the compositions shown in Table 10, were cast in a strip casting machine with twin counter-rotating rolls at a thickness of 2.8 mm and, during the subsequent cooling, were hot rolled at the starting temperature of 1180° C. at a final thickness of 2.0 mm, and then coiled at 580° C.

TABLE 10

| n° | C [ppm] | Si [%] | Als [ppm] | N [ppm] | Mn [ppm | S [ppm | Cu [ppm |
|---|---|---|---|---|---|---|---|
| A | 500 | 3.15 | 280 | 80 | 740 | 230 | 1000 |
| B | 500 | 3.15 | 30 | 20 | 700 | 240 | 2100 |

The oxygen content of the strips, measured after removal of the surface scale, was, respectively, of 22 and 18 ppm.

A number of samples were obtained from the strips, and subjected to laboratory treatments.

The strips were then annealed at 1000° C. for 50 s, pickled and cold rolled to the following thickness: 1.8 mm, 1.4 mm, 1.0 mm, 0.8 mm, 0.6 mm.

Both the cold rolled strips and the above samples were then annealed with a cycle comprising a first stop at 1130° C. for 5 s, and a second stop at 900° C. for 40 s, quenched starting from 750° C. and pickled.

The strips were then cold rolled to a thickness of 0.30 mm, decarburised at 850° C. on a wet hydrogen+nitrogen atmosphere, coated with an MgO based annealing separator an box annealed with a heating rate of 15° C./s from 25 to 1200° C. in a 25% N2 75% $H_2$ atmosphere, and held at 1200° C. for 20 h in pure hydrogen. The strips were then thermo-flattened and coated with a tensioning coating. The obtained magnetic characteristics are shown in Table 11.

TABLE 11

| Thickness | % Final Reduction | B800 [mT] Steel A | B800 [mT] Steel B |
|---|---|---|---|
| 2 | 85 | 1950 | 1610 |
| 1.8 | 83 | 1945 | 1605 |
| 1.4 | 79 | 1910 | 1720 |
| 1 | 70 | 1890 | 1830 |
| 0.8 | 63 | 1750 | 1850 |
| 0.6 | 50 | 1700 | 1820 |

The invention claimed is:

1. A process for the production of grain oriented electrical steel by direct casting in the form of a strip 1.5–5 mm thick a molten steel comprising 2.5–3.5 wt % Si, up to 1000 ppm C, and elements apt to obtain a fine precipitation of second phases of sulphides/selenides and/or nitrides as grain growth inhibitors, the remaining being iron and other elements not essential for the final quality of the product, said steel being subjected to the following process steps in sequence:

direct casting in the form of a strip, so that the total oxygen content of the cast steel, once removed the surface scale, is less than 30 ppm;

continuous hot rolling of the strip outcoming from the casting machine while it cools down, at a rolling starting temperature comprised between 1000 and 1250° C., with a reduction ratio of between 15 and 50%;

coiling the hot rolled strip at a temperature less than a given T max temperature, function of the chosen inhibitors;

possible annealing of the hot rolled strip, cold rolling of said strip, possibly in double stage with an intermediate annealing, with a reduction ratio in the last stage of between 50 and 93%, decarburisation annealing, possibly nitriding, coating the decarburised strip with an MgO based annealing separator, and annealing for secondary recrystallisation;

coating with an insulating and possibly tensioning coating.

2. The process according to claim 1, in which the steel is cast utilizing a twin, cooled and counter-rotating rolls device.

3. The process according to claim 1, in which the sulphides/selenides are chosen between those containing Cu and/or Mn.

4. The process according to claim 1, in which the nitrides are chosen between those containing Al.

5. The process according to claim 3, in which the elements chosen for the precipitation of the second phases are chosen between S+(16/39)Se: 50–300 ppm; Mn 400–2000 ppm; Cu<3000 ppm; and in which the strip after in-line hot rolling is coiled at a temperature of less than 780° C.

6. The process according to claim 5, in which the strip is then annealed, quenched, pickled and cold rolled, possibly in double stage with an intermediate annealing, down to a thickness of between 0.15 and 0.5 mm.

7. The process according to claim 4, in which the elements chosen for the precipitation of the second phases are N 60–100 ppm and Al 200–400 ppm, and the strip after in-line hot rolling is coiled at a temperature of less than 600° C.

8. The process according to claim 7, in which the strip is then annealed at a temperature comprised between 800 and 1150° C. and quenched.

9. The process according to claim 8, in which the quenched strip is cold rolled at a thickness comprised between 0.15 and 0.5 mm, possibly in double stage with intermediate annealing, with a reduction ratio in the last rolling comprised between 60 and 93%.

10. The process according to claim 1, in which the elements added for the precipitation of the second phases are chosen between: S+(16/39)Se: 50–250 ppm; Mn: 400–2000 ppm; Cu:<3000 ppm; N: 60–100 ppm; Al: 200–400 ppm, and the strip, after hot rolling, is coiled at a temperature of less than 600° C.

11. The process according to claim 10, in which the strip is uncoiled and annealed at temperatures of between 800 and 1150° C., and then quenched.

12. The process according to claim 11, in which the strip, after quenching, is cold rolled to a thickness comprised between 0.15 and 0.5 mm, possibly in double stage with intermediate annealing, with a reduction ratio in the last rolling of between 60 and 93%.

13. The process according to claim 1, in which at least an element chosen between Nb, V, Ti, Cr, Zr and Ce is added to the steel composition.

14. The process according to claim 13, in which the strip, after hot rolling, undergoes the following treatments: coiling at a temperature comprised between 600 and 780° C., annealed at temperatures comprised between 800 and 1150° C., cold rolled, possibly in double stage with intermediate annealing, to a thickness comprised between 0.15 and 0.5 mm with a reduction ratio in the last rolling of between 60 and 93%, decarburisation annealed and nitrided in the last part of the decarburisation annealing by addition of ammonia to the furnace atmosphere.

15. A process for the production of grain oriented electrical steel by direct casting in the form of a strip 1.5–5 mm thick a molten steel comprising 2.5–3.5 wt % Si, up to 1000 ppm C, and elements apt to obtain a fine precipitation of second phases of sulphides/selenides and/or nitrides as grain growth inhibitors, the remaining being iron and other elements not essential for the final quality of the product, said steel being subjected to the following process steps in sequence:

direct casting in the form of a strip, so that the total oxygen content of the cast steel, once removed the surface scale, is less than 30 ppm;

continuous hot rolling of the strip outcoming from the casting machine while it cools down, at a rolling starting temperature comprised between 1000 and 1250° C., with a reduction ratio of between 15 and 50%;

coiling the hot rolled strip at a temperature below a predetermined temperature, said predetermined temperature being determined in dependence upon said grain growth inhibitors that are present in said strip; and annealing and cold rolling of the hot rolled strip.

* * * * *